United States Patent [19]

Restarick, Jr. et al.

[11] Patent Number: 4,736,797

[45] Date of Patent: Apr. 12, 1988

[54] JARRING SYSTEM AND METHOD FOR USE WITH AN ELECTRIC LINE

[76] Inventors: Henry L. Restarick, Jr., 4913 Lake Louise, Metairie, La. 70006; Ronald D. Thomas, 2803 Forest Garden Dr., Kingwood, Tex. 77345

[21] Appl. No.: 39,634

[22] Filed: Apr. 16, 1987

[51] Int. Cl.[4] ..... E21B 31/107

[52] U.S. Cl. ..... 166/301; 166/65.1; 166/178; 166/385

[58] Field of Search ..... 166/301, 178, 385, 65.1; 175/293, 300, 301

[56] References Cited

U.S. PATENT DOCUMENTS

| | | | |
|---|---|---|---|
| Re. 28,768 | 4/1976 | Mason | 175/297 |
| 46,815 | 3/1865 | Noe | 175/293 |
| 51,136 | 11/1865 | Bump | 166/106 X |
| 1,214,622 | 2/1917 | Walker | 166/178 |
| 1,450,024 | 3/1923 | Edwards | 175/293 X |
| 2,305,261 | 12/1942 | Kinley | 166/301 X |
| 2,628,820 | 2/1953 | Sheak | 166/85 |
| 2,739,654 | 3/1956 | Kinley et al. | 166/178 X |
| 3,054,454 | 9/1962 | Evans | 166/178 |
| 3,358,765 | 12/1967 | Le Blanc | 166/301 |
| 4,427,064 | 1/1984 | Bowyer | 166/178 X |

*Primary Examiner*—Stephen J. Novosad
*Attorney, Agent, or Firm*—C. Emmett Pugh

[57] ABSTRACT

A jarring apparatus for use with an electric line for upward jarring of a tool element stuck in an oil well including a tubular member having a tool element attached to its lower end. A hammer disposed in the tubular member is attached to a cylindrical rod for motion therewith by an electric line disposed through a longitudinal bore in the rod and is moved from a first configuration upwards to a second configuration by a quick, generally upward motion of the electric line toward an opposed anvil included with the tubular member, the quick generally upward motion of the cylindrical rod from its first configuration to its second configuration rapidly moving the hammer to strike against the anvil to provide a generally upward jarring action which is transmitted to jar the element in a generally upward direction. If the jarring does not loosen the stuck tool, disconnect means are provided for leaving the tubular member and tool element in the well but retrieving the electric line.

34 Claims, 3 Drawing Sheets

JARRING SYSTEM AND METHOD FOR USE WITH AN ELECTRIC LINE

BACKGROUND OF THE INVENTION

1. Field of the Invention

The present invention relates generally to a jarring mechanism for use in a well bore and more specially to a jarring apparatus for use with an electric line that provides an upward jarring action to a stuck tool element suitable for use with for example an electric line.

2. Prior Art and General Background

In general, it has been found useful in an oil well or the like to use a jarring mechanism to free stuck elements. For example, see U.S. Pat. No. 1,214,622 to H. B. Walker (issued Feb. 6, 1917) in which tubing is jarred or pulled so as to shear screws to release a tubular extension of a packer from connection with a tubing or outer casing. The tubing can be now moved up and down independently of the packer and by bringing the lower closed ends of the slots of a sleeve into engagement with lugs or enlargements the packer may be jarred and jolted or lifted from its position and dislodged. It has also been found useful to use jars to impart rotational movement in an oil well. For example, U.S. Pat. No. 46,815 to Noe (issued March, 1865), discloses a jar in which one element is provided with spiral grooves and another element is provided with pins or projections which travel therein and impart relative rotational movement between the two elements. For other devices operating on similar principles, see U.S. Pat. Nos. 1,450,024 and 2,739,654. For a device which imparts rotational movement to an arbor lowered into a well on a wire line or cable by including a jar for imparting blows to the arbor in order to cause the arbor to rotate in a drag spring assembly engaged with the bore wall, see U.S. Pat. No. 3,054,454 to Evans (issued Sept. 18, 1962). The device includes cams on the arbor and a cam follower is included with the drag spring assembly for causing the rotation of the arbor when it is moved vertically with respect to the drag spring assembly.

For other patents which may be of a similar interest see, for example, U.S. Pat. No. Re. 28,768 to Mason (reissued Apr. 13, 1976) which discloses a jarring and bumping tool for use in an oil field drilling string. See also U.S. Pat. No. 2,628,820 Sheak (issued Feb. 17, 1953), which discloses a pipe puller and is related to improvements in pulling devices and more specifically to well casing pullers. For another patent which may be of interest, see U.S. Pat. No. 51,136 to Bumn (issued Nov. 28, 1865), in which a cylinder may be withdrawn by drawing a piston upward beyond its stroke, so that it will strike with a jar against a shoulder or flange allowing the cylinder to be disengaged from the outer pipe so that it may be drawn up to the top of the well.

For a patent which is directed to the problem of a pressure differential, which may exist across a tool such as a separation which is locked in place within a well casing sleeve; see U.S. Pat. No. 4,427,064 (Bowyer, issued Jan. 24, 1984). The disclosure described a no-blow tool which automatically anchors itself by means of serrated slips which are radially expandable outward into a gripping engagement with the casing and an associated wire line string in response to a rapid upward movement of a pulling tool run below the no-blow tool. The no-blow tool utilizes light, upwards jarring to free the serrated slips in order to retrieve the wire line string, and allows downward shearing of a further set of shear pins to allow a hammer to transmit downward jarring directly to the pulling tool without interference fom the slip assembly to permit the retrieval of the entire wire line tool assembly.

Another oil field procedure or operation which may result in a tool becoming stuck in a well bore are commonly termed electric line operations such as open hole well logging, cased hole logging, dipmeter, side wall cores, perforating, "Baker" setting tools and RFT tools. Examples of open hole well logging tools include, for example, "ISF-Sonic" and "Densilog" and examples of cased hole tools include, for example, "CBL-VDL" and "Neutron Lifetime Log."

With these types of operations, an electric line tool would be generally lowered into a well bore with the tool connected to the lower end of the electric line. While being lowered, the tool may stick for various reasons including, for example, differential sticking, which is caused by a pressure differential between a higher pressure in the well bore and a lower pressure in the surrounding formation. This may generally cause the tool to be sucked against the bore wall by the pressure differential, resulting in a differentially stuck tool.

This condition may be alleviated, for example, by lowering the mud weight to reduce the pressure differential and aid in freeing the stuck tool. However under certain conditions the tool will still remain stuck to the side of the well bore.

Another example of sticking would be pads which extend outward from logging tools digging in and becoming stuck in a void along the bore wall. Once stuck, the tool may be unstuck by increasing the hoisting force. However, in some instances the connection between the tool and the elecric line may not be able to withstand an increased hoist force sufficient to unstick the tool, and an attempt to increase the hoisting force may only pull the electric line loose from the tool, necessitating going into the hole with fishing tools to retrieve the stuck tool.

Prior to this invention it was apparently not known or considered feasible to employ a jarring apparatus with an electric line operation to free an electric line tool. Applicants know of no concept which allows jarring to be used with an electric line, and it is to this problem that the present invention is directed.

Further, so far as known to applicants, the prior art discloses no arrangement which is suitable for providing upward jarring to an electric line tool element which has become stuck in a well bore.

3. General, Summary Discussion of the Invention

It is an object of the invention of the present method and apparatus is to provide a new method and apparatus suitable for use with an electric line for jarring loose a tool element, which is stuck in a well, by a quick, generally upward motion of an electric line. In accordance with this object, it is an object of the method and apparatus of the invention that the jarring provide an upward jarring action to loosen the stuck tool element.

It is a further object of the present method and apparatus or system of the present invention that the motion of the electric line may be reciprocal to provide a series of jarring actions to loosen the stuck tool element.

Accordingly, it is a feature of the present invention that the electric line be disconnected from the tool element responsive to a first predetermined force in the electric line, while remaining in attached configuration to a hammer which is released from a first configuration by a second predetermined force in the electric line to move upwards by the quick, generally upward motion of the electric line to a second configuration to strike a spaced anvil to provide the upward jarring action which is transmitted to the stuck tool element.

A further object of the method and apparatus or system of the present invention is to provide a means for releasing the tool element from the apparatus responsive to a third predetermined force in the electric line which is higher than the first predetermined force and the second predetermined force. In accordance with this object, the electric line, which may include portions of the apparatus of the present invention, may be withdrawn from the well, allowing fishing tools to be used to remove the stuck tool element.

In accordance with this object, a means which retains the hammer in its first configuration aids in absorbing the initial rapid upward motion of the hammer as it moves toward its second configuration to restrain premature releasing of the means for releasing the tool element from the apparatus.

A further object of the method and apparatus of the present invention is to provide an arrangement suitable for a series of jarring actions to loosen the stuck tool element. In accordance with this object, it is a feature of the present invention that the hammer may be returned to a lower configuration which may be the same as the first configuration responsive to the lowering of the electric line, and that a further quick, generally upward motion of the electric line move the hammer upward toward the second configuration, so that a series of upward jarring actions may be made which may be transmitted to loosen the stuck tool element.

In accordance with these objects, the arrangement includes a tubular member disposed in a well with a tool element disposed below and attached thereto, a hammer which is moveable upwards from a first configuration to a second configuration by a generally quick, upward motion of an electric line to strike an opposed, spaced anvil to provide a generally upward jarring action to jar the element, means for transferring the upward jarring action from the anvil to the element and jar the element in a generally upward direction, means for leaving the tool element disposed in the well below a tubular member in its attached configuration with the tubular member, and means for disconnecting the electric line from the tool element responsive to a first generally upward force in the electric line.

Accordingly, the arrangement further includes a cylindrical rod slidably disposed in the tubular member having a central longitudinal bore therethrough with the electric line extending through its bore and connected at its lower end to the tool element, means associated with the cylindrical rod and the tubular member for releasing the cylindrical rod from a first configuration responsive to a second predetermined force in the electric line, and means responsive to a generally upward motion of the electric line for moving the cylindrical rod from a first configuration in the tubular member to a second configuration. In further accordance, the hammer is attached to the cylindrical rod for motion therewith by the upward motion of the electric line toward the opposed spaced anvil, and the opposed anvil is fixedly attached to the tubular member, the quick, generally upward motion of the cylindrical rod from its first configuration to its second configuration moving the hammer to strike against the anvil and provide a generally upward jarring action.

In accordance, the first configuration is a lower configuration and the second configuration is an upper configuration, the motion of the electric line may be reciprocal, and the arrangement includes a means for moving the cylindrical rod downward from its second configuration responsive to a downward motion of said electric line to a further lower configuration which may be the same as the first configuration. Thus, the reciprocal motion of the electric line provides a means for a reciprocal motion of the rod and hammer, so that the reciprocal motion of the hammer provides a series of jarring actions.

The above objects and other objects as well as features of the present invention will become apparent from the drawings, the description given herein, and the appended claims.

BRIEF DESCRIPTION OF THE DRAWINGS

The invention may be more fully understood by reference to the following description of the preferred embodiment in conjunction with the drawings, wherein.

DETAILED DESCRIPTION OF THE PREFERRED, EXEMPLARY EMBODIMENTS

First Exemplary Embodiment

Figure 1:
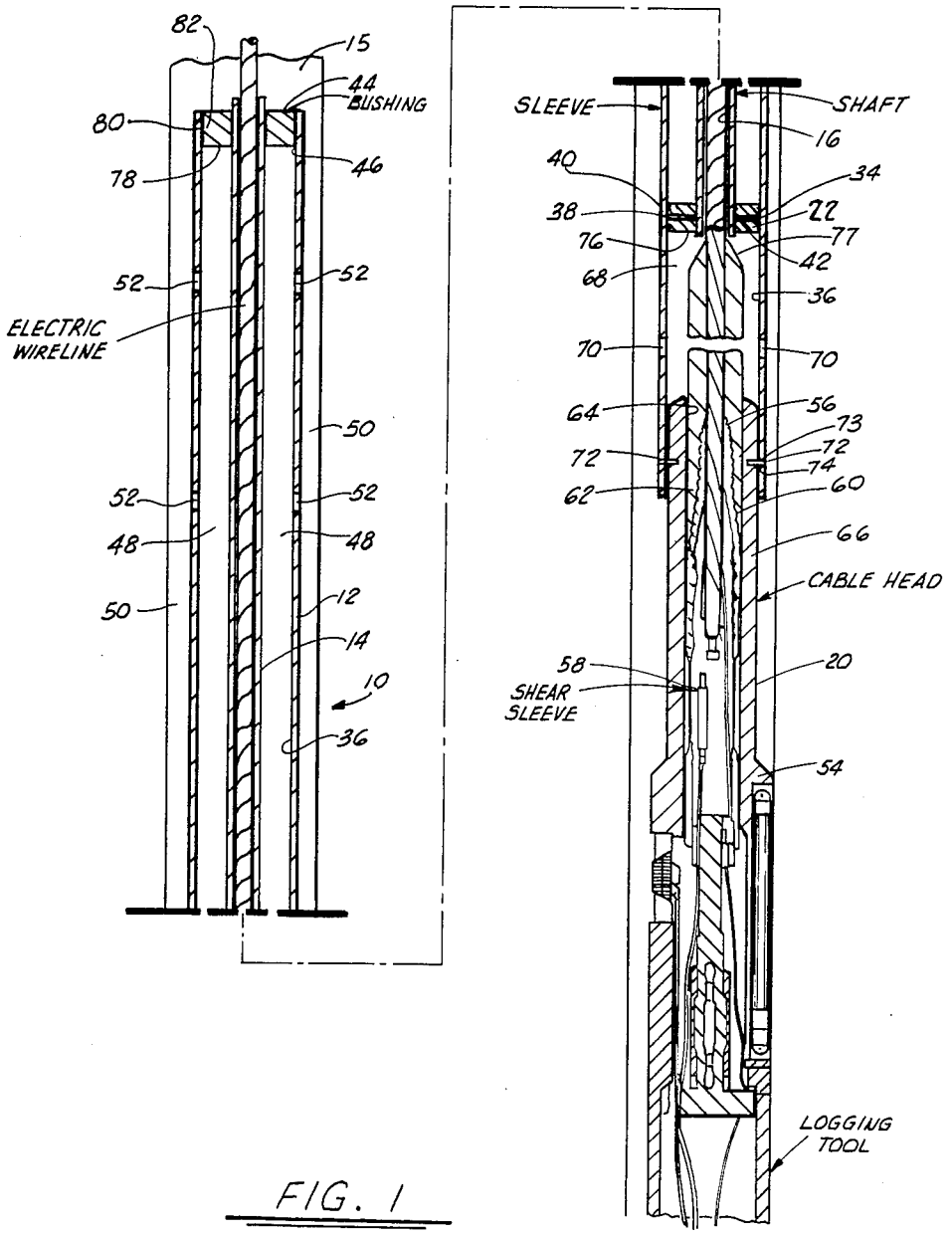
FIG. 1 is an cross-sectional, elevational view of a preferred embodiment of the apparatus according to the present invention, with the rod and hammer shown in their first configuration.

Referring to the drawings, a preferred embodiment of a jarring apparatus, shown generally as 10, comprises an elongated tubular member 12 and a cylindrical rod 14 slidably disposed in the tubular member 12. The jarring apparatus 10 is disposed in a well 15 and an electric line 18 extends downward through a central longitudinal bore 16 in rod 14. The bore 16 is generally cylindrical and may be formed by any suitable means such as boring, with a suitable clearance between the walls of bore and the electric line being for example one-sixteenth of an inch, although of course other suitable clearances may also be used.

The electric line 18 extends downward through bore 16 and connects to a tool element 20 disposed in well 15 below tubular member 12. Tool element 20 is attached to tubular member 12 by a suitable means, which will be described hereafter, so that the apparatus 10, including the well tool 20, may move together in the well 15.

The tool element 20 may be any type of tool which may be run with an electric line. For example, the tool element 20 may be, and one of the most appropriate is, a logging tool such as an "ISF-Sonic" or "Densilog" tool. The tool may also be for further examples a dipmeter, a sidewall coring tool, and RFT tools. Other tool elements which are suitable for cased holes logging services, such as a "CBL-VDL" tool, "Neutron Lifetime Log" tool, perforating tools and "Baker" setting tools suitable for setting packers on an electric line may also be used. It is also within the scope of the invention that the tool elements may be piggy backed, that is two or more, when suitable and convenient.

A hammer 22 is attached to rod 14 for motion therewith and, as shown in the preferred embodiment, comprises an annular shoulder which extends radially around the lower end of rod 14. Hammer 22 may be formed integrally with rod 14 by suitable means such as machining, although other suitable means may be provided such as shown in the figures. As shown, hammer 22 may include a piston shaped portion having a threaded axial bore 24 engaged with a threaded portion 26 along the bottom end of rod 14. A suitable means such as a set screw 28 may be used to restrain hammer 22 from becoming unthreaded from threaded portion 26. As may be appreciated, set screw 28 would be threadably disposed in a threaded bore 30 in hammer 22, with its enclosed end 32 in frictional contact with threaded portion 26 to restrain hammer 22 from rotating on threaded portion 26.

The cylindrical wall portion 34 of hammer 22 has a suitable clearance with the inner cylindrical wall 36 of tubular member 12 for slidable motion thereon. A suitable clearance being for example one-sixteenth of an inch, although other clearances may be used also. A suitable lubricant such as ordinary cup grease may be applied to portion 34 and inner wall 36 to reduce friction, as hammer 22 slides along inner wall 36.

Figure 2:
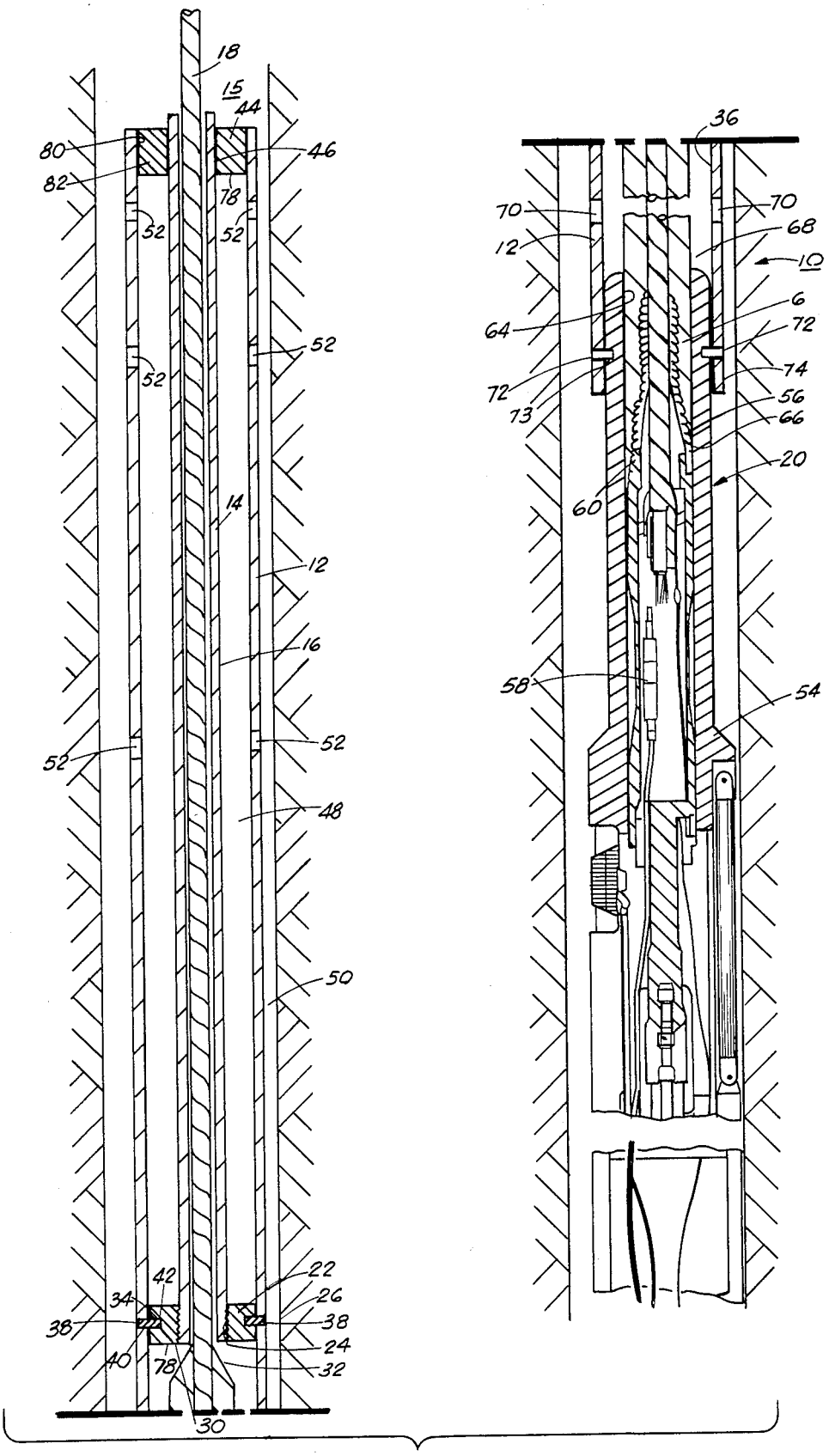
FIG. 2 is a cross-sectional view of the preferred embodiment of the apparatus according to the present invention as shown in FIG. 1.

A shearable means, which may be a shear pin 38 by way of example only positions rod 14 and hammer 22 in a first configuration as shown in the FIGS. 1 and 2. A radial bore 40 is made in tubular member 12 by suitable means such as drilling, and hammer 22 is provided with an annular groove 42 surrounding cylindrical wall portion 34. Hammer 22 is positioned in tubular member 12 in its first configuration, with groove 42 aligned with bore 40. Shear pin 38 is inserted into bore 40 and held there by a suitable means, such as a threaded connection with bore 40 with its enclosed end positioned in groove 42 to retain rod 14 and hammer 22 in their first configuration. Shear pin 38 provides means for releasing rod 14 from its first configuration responsive to a second predetermined force for purposes which will be described in detail later.

An annular bushing 44 extends radially inward from the interior wall 36 of the upper end of tubular member 12 and includes a central bore 46. The upper end of rod 14 is slidably disposed therein, and a suitable clearance is included between bore 46 and rod 14 for slidable motion therein, a suitable clearance being one-sixteenth of an inch, although other clearances may be used also. A suitable lubricant such as cup grease may be applied to bore 46 and rod 14 to reduce friction, as rod 14 slides in bore 46.

Included between the interior wall 36 of tubular member 12 and the peripheral surface of rod 14 is an elongated annular void 48. Annular void 48 is enclosed at its upper end by the lower annular surface of bushing 44 and is enclosed at its lower end by the upper annular surface of hammer 22. A means is included for communicating the void 48 with an annulus 50 surrounding tubular member 12. As shown in the figures, the means may comprise pairs of opposed, spaced radial bores 52 along the length of tubular member 12 between bushing 44 and hammer 22, when rod 14 and hammer 22 are in their first configuration. Bores 52 may be formed by drilling, although any other suitable means may be used also. It is also within the scope of the invention, that any other suitable means, such as for further example a solitary radial bore positioned near the top of tubular member 12 and below the lower surface of bushing 44, may be used to communicate void 48 with annulus 50.

As mentioned, hammer 22 is retained in its first configuration by shear pin 38. In the event tool element 20 has become stuck as it is lowered into the well 15, an upwards hoisting force may be applied to the electric line 18 by any suitable means known to the art. As the hoisting force is increased and without the advantages of the present invention, the electric line 18, would upon reaching a sufficient hoisting force, pull loose from its connection with the tool element, necessitating a trip into the well with fishing tools to retrieve the stuck tool. Although increasing the hoisting force to a level less than that required to disconnect the tool element from the electric line will many times free the tool element and allow operations to continue, for those occurrences in which the electric line is pulled loose, the time involved and the extra expense of fishing tools make the delay costly. It is to these occurrences which the present invention is directed.

Tool element 20 includes a means for disconnecting electric line 18 from its attachment thereto. In general the means for disconnecting would be responsive to an upwards force in the electric line 18 which is below the breaking strength of electric line 18.

As shown in the figures, tool element 20 is indicated as a logging tool 54 with the electric line 18 attached to the tool 54 by suitable means known to the art, such as a rope socket 56 and a shearable sleeve 58 for connecting electrical components such as wiring together. The rope socket 56 is included in a downward, outward flaring conical shaped bore 60 of a mandrel 62, with the mandrel 62 being held in a longitudinal bore 64 in the cable head 66 of tool 54 by suitable means, which may be for example a force fit. When the lifting force has been increased in electric line 18 to a first predetermined force which is sufficient to disconnect the electric line 18 from socket 56 and cause shearing of shear sleeve 58, which may be for example 2800 pounds, the electric line 18 pulls loose and becomes disconnected from the tool.

A second void 68, which may be annular as shown in the figures, is formed by the space between the inner wall 36 of tubular member 12 below hammer 22 and the outer peripheral surface of tool element 20. Void 68 is enclosed at its ends by the lower annular surface of hammer 22 and a surface extending outward from tool element 20, shown in the figures as the annular upper surface of cable head 66.

A means is included for communicating void 68 with annulus 50. The means may be the same as the means for communicating void 48 with annulus 50. As shown in the figures, the means may comprise a pair of opposed radial bores 70, which may be formed by a similar means such as bores 52 or by other suitable means. It is noted that, should the tool element be disjunctive along a portion of its periphery with the lower peripheral annular surface of tubular member 12, an opening would exist for communicating void 48 with annulus 50, and other suitable means, such as bores 70, for communicating void 48 with annulus 50 may not then be necessary, and such is within the scope of the invention.

A means is included for leaving tubular member 12 disposed in well 15 above tool element 20 in its attached configuration with element 20, when electric line 18 becomes disconnected from tool element 20. The means may be a shearable element, and, as shown in the figures, may comprise a pair of opposed shearable allen screws 72, which are given by way of example only.

For ease of assembly, the tool element 20 may be provided with a groove in which the enclosed ends of the allen screws may be positioned. With the tool element 20 being the logging tool 54 as shown in the figures, an annular groove 73 is included surrounding cable head 66. Radial bores 74 are made in tubular member 12 by suitable means such as drilling and are threaded by suitable means. Cable head 66 is inserted upward into tubular member 12 and groove 73 aligned with bores 74. Allen screws 72 are threadably inserted in bores 74, with their enclosed ends positioned in groove 73 to retain logging tool 54 in its attached configuration with tubular member 12. The screws 72, as mentioned, provide means for leaving the tubular member 12 in an attached configuration with the tool element 20 for purposes which will be described in detail hereafter.

A means associated with cylindrical rod 14 and tubular member 12 is included for releasing rod 14 from its first configuration responsive to a second predetermined force in the electric line 18. As shown in the figures, the means may comprise the aforementioned shear pin 38, and the second predetermined force may be of a value lower than the first predetermined force necessary to disconnect the electric line 18 from element 20. Hence, shear pin 38 may have a low shear strength, which shears, for example, at 150 pounds.

As may be appreciated shear pin 38 provides a means to retain rod 14 and hammer 22 in their first configuration until electric line 18 disconnects from tool element 20, and hence may have any value suitable for this purpose. The means provides releasable means for preventing premature movement of rod 14 until disconnection of electric line 18 from element 20 has occurred, and hence its value need only be of a strength sufficient to retain rod 14 and hammer 22 in their first configuration during normal operations that occur within hole 15.

As may further be appreciated, the means for releasing rod 14 from its first configuration further provides means, along with any fluid in annular void 48 which would have to be displaced to the annulus 50 by means of bores 52, for slowing the initial upward motion of rod 14 as electric line 18 disconnects from tool element 20 to restrain premature shearing of allen screws 72. As may further be appreciated, the value of shear pin 38 would for both purposes only need to be of low shear strength such as the aforementioned exemplary 150 pounds.

As mentioned, a means is attached to the upper end of electric line 18 to raise and lower electric line 18 and jarring apparatus 10, including tool element 20 in the well 15. The motion of electric line 18 in the well is generally translatory, and the means may be any suitable hoist as known to the art, and any suitable means suitable to raise and lower the electric line 18 may be used.

Figure 3:
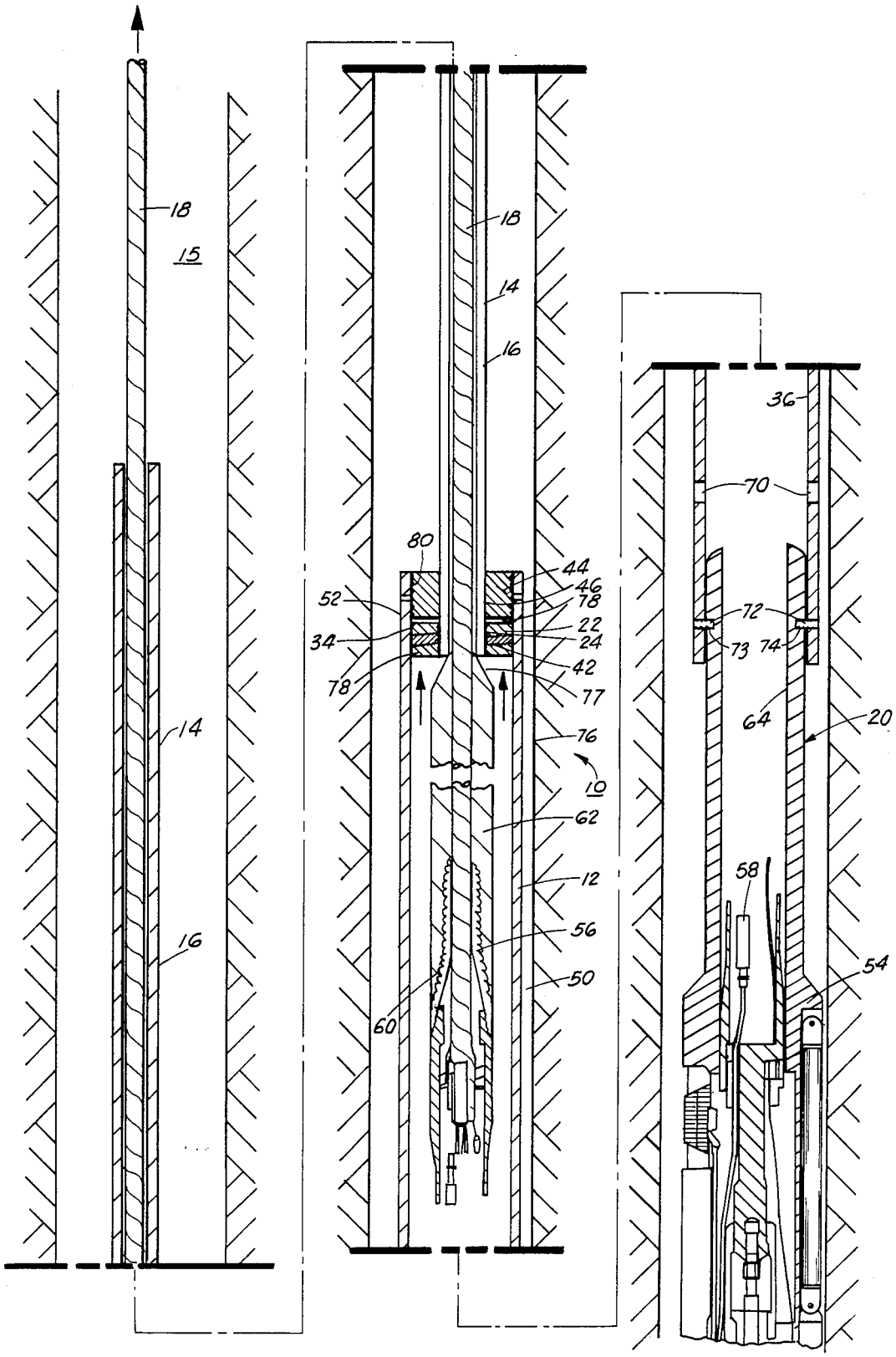
FIG. 3 is a cross-sectional view of the preferred embodiment of the apparatus of the present invention shown in FIG. 1, with the rod and hammer shown in their second configuration.

With tool element 20 stuck in the well 15, a means is provided responsive to a generally upward motion of the electric line 18 for moving the cylindrical rod 14 from its first configuration in the tubular member 12 to a second configuration as shown in FIG. 3. With electric line 18 disconnected from element 20 and rod 14 released from its first configuration as previously discussed, electric line 18 is free to move upwards, responsive to an upwards hoisting force applied to the upper end of electric line 18 by the hoist. With the tool element 20 being specifically a logging tool 54 as shown in the figures, the means comprises the lower annular face 76 of rod 14 and hammer 22 surrounding bore 16 and includes the annular outwardly flaring tip 77 of mandrel 62. The abutment of tip 77 against annular face 76 and bore 16 provides means responsive to an upward motion of the electric line 18 for moving the rod 14 and hammer 22 from their first configuration to the second configuration.

As may be further appreciated the means for moving rod 14 from its first configuration to its second configuration further includes means for retaining rod 14 in an attached configuration with electric line 18. As may be appreciated, electric line 18 is retained at least partially in bore 16, and as shown in the figures, extends downward through bore 16, so that rod 14 moves concurrently therewith. It is to be appreciated that with other tool elements 20 the means for moving rod 14 from its first configuration to its second configuration including means for retaining rod 14 in an attached configuration with electric line 18 may vary.

An annular anvil 78 comprising the bottom annular portion of bushing 44 is positioned opposite and a distance away from hammer 22. As may be appreciated, the movement of rod 14 and hammer 22 from their first configuration to their second configuration by the upward motion of the electric line causes hammer 22 to strike anvil 78. The upward motion of the electric line 18 is a quick, generally upward motion, with the upper end of rod 14 sliding upwards through bore 46 and hammer 22 sliding upwards along the interior wall 36 of tubular member 12, so that hammer 22 strikes with sufficient force and momentum against anvil 78 to jar the tool element 20 upward to release the element from its stuck position in the well 15. As may be appreciated, rod 14 and hammer 22 have sufficient mass to impart a jarring action to anvil 78, and the distance traveled by hammer 22 as it slides upwards in tubular member 12 is sufficient for momentum to be built, which may then be transferred to anvil 78 as it is struck by hammer 22. For this, rod 14 is preferably elongated, and hammer 22 is attached to a bottom portion of rod 14 as previously noted, with anvil 78 spaced upwards in tubular member 12 a distance from hammer 22. As further may be appreciated, anvil 78 includes the bottom annular portion of bushing 44, with bushing 44 being fixedly attached to tubular member 12.

A means for transferring the upward jarring action from anvil 78 to element 20 is included with the apparatus 10. The means includes anvil 78's fixed attachment to tubular member 12 and the means for leaving tubular member 12 in its attached configuration with the tool element 20. As shown in the figures and as previously described, the means for leaving tubular member 12 in its attached configuration with element 20 comprises shearable allen screws 72. The shear strength of screws 72 is higher than both the first predetermined pressure and the second predetermined pressure in the electric line 18 and would be a strength below that of the breaking strength of electric line 18, with a preferred shear strength of screws 72 being on the order of eighty percent of the tensile breaking strength of electric line 18. For an electric line which has a 4000 pound tensile capacity, the shear strength of screws 72 may be for example 3200 pounds.

The high shear strength of screws 72, along with shear pin 38, which provides as previously mentioned means for slowing the initial upward motion of rod 14 as electric line 18 disconnects from tool element 20, along with any fluid in annular void 48 which would be displaced to the annulus 50 by means of bores 52, serves to restrain premature shearing of allen screws 72. This allows the electric line 18 to be hoisted in a quick, upward translatory motion to cause rod 14 and hammer 22 to move upward with sufficient momentum and inertia to strike hammer 22 against anvil 78 and deliver an upward jarring action to anvil 78. This action in turn is transmitted to tool element 20 by the means for transferring the upward jarring action from anvil 78 to element 20, including anvil 78's attachment to tubular member 12 and tubular member's 12 attachment to tool element 20. As may be appreciated, the generally high shear strength of screws 72, along with shear pin 38 and the fluid which must be displaced from void 48 by means of bores 52, restrain premature shearing from taking place and allows upward jarring to be transmitted.

Hence, as may be seen by the attachment of anvil 78, tubular member 12 and tool element 20, any jarring motion imparted to anvil 78 by hammer 22 is transferred to tool element 20. As may further be appreciated, bushing 44 including anvil 78 may include a threaded portion 80 surrounding their circular periphery, which is threadably engaged with a threaded portion 82 in tubular member 12 to rigidly fix bushing 44 and anvil 78 therewith, so that the jarring motion may be transferred from anvil 78 to tubular member 12 by means of their rigid attachment, and from tubular member 12 to tool element 20 by means of allen screws 72. It is further appreciated that bushing 44 and anvil 78 have a suitable thickness that the upward jarring action would not, for example, strip their threaded engagement with tubular member 12 and allow rod 14 and hammer 22 to be ejected upward from the jarring apparatus 10 into the well.

In the event multiple upward jarring or a series of upward jarring actions is necessary, rod 14 and hammer 22 may be moved to a lower configuration in tubular member 12 by lowering the electric line 18 with a generally translatory motion. The lower configuration may be the same as the first configuration, although any lower configuration which allows rod 14 and hammer 22 to rapidly move upwards so that hammer 22 strikes anvil 78 with a jarring action is sufficient. The weight of rod 14 and hammer 22 generally allow the rod and hammer to move to the lower configuration.

To further aid in returning rod 14 and hammer 22 to the lower configuration, the electric line 18 may be frictionally engaged with bore 16 so that as the electric line 18 is lowered with a generally translatory motion, the weight of the electric line 18, as may be appreciated, assisting in returning rod 14 and hammer 22 to the lower configuration. Further included for returning rod 14 and hammer 22 to a lower configuration may be a light compression spring which is not shown in the figures. The spring would be positioned in annular void 48 so that its coils surround rod 14, with its upper end in abutment with the lower annular surface of bushing 44 and with its opposite end in abutment with the upper annular surface of hammer 22. As rod 14 moves from the first configuration to the second configuration, the spring would be compressed between these opposed surfaces to provide an additional means for returning rod 14 and hammer 22 to a lower configuration in tubular member 12.

Method of Operation

In the operation of the embodiment illustrated in the figures, the jarring apparatus 10, including tool element 20 in the form of logging tool 54 which may be a resistivity tool, or any other type of logging tool which is appropriate, and the electric line 18 are assembled with rod 14 and hammer 22 in their first configuration and the jarring apparatus 10 lowered into the well 15 by a suitable hoist.

Well 15 may be drilled in a manner to deviate the well bore, providing a well 15 which may be described as being generally vertical, and the jarring apparatus 10 including tool element 20 is lowered into the well 15. As the tool element 20 is lowered into the well 15, it is known that sticking of the element may occur, and that sticking will have a higher rate of occurrence in wells which have been deviated. With wells which have been directionally drilled or deviated there is a chance of a key seat as previously described being formed in the upper portion of the well bore by rubbing of the drill pipe as the well is drilled. Other conditions which may contribute to sticking include the previously mentioned differential sticking. As the tool is lowered into the well 15 or hole by a generally translatory motion of electric line 18, a reduction in the hoist force would be noted, indicating the tool element 20 has stuck in well 15 for various reasons, including the aforementioned key seating and differential sticking.

With the jarring apparatus 20 of the present invention, jarring procedures may now be undertaken to free the tool element 20 for further movement in the well bore.

In the past, this would have been limited to increasing the upward hoist force and possibly lowering the mud weight in case the tool is differentially stuck. However, it is not generally possible to cut the mud weight without circulating the mud, and this procedure would generally require either cutting the electric line or continue pulling an upward hoist force until it has exceeded a certain value and the electric line becomes disconnected from tool element 20, pulling the electric line or its remainder out of the hole and lowering at least a portion of drill string into the hole in order to circulate, and then use fishing tools to try to recover the stuck tool element. This procedure may require additional personnel and equipment and would add to the drilling expense by not only these costs, but also the cost of lost rig time.

However, with the present invention, upwards jarring may be initiated to free the stuck tool element 20. As may be appreciated, this is accomplished with the present invention by increasing the upward hoisting force to apply the first predetermined upward force to the electric line 18 and disconnect electric line 18 from tool element 20. At this point the second predetermined upward force may be applied by the upward motion of the electric line 18 to release rod 14 and hammer 22 from their first configuration. As electric line 18 is disconnected from element 20 and rod 14 is released from its first configuration, rod 14's upward movement is initially slowed by the shearing of shear pin 38 and the necessary expulsion of fluid from void 48 by means of bores 52, and the high strength of allen screws 72 provide means for leaving the tubular member 12 in its attached configuration with tool element 20, and both prevent the separation of tubular member 12 and element 20 in order to prevent tubular member 12 from being freely withdrawn upwards in hole 15 without corresponding movement of element 20, while allowing upward jarring action to be transferred to tool element 20. As may further be appreciated, any light spring which is placed in annular void 48 as previously mentioned would additionally serve to slow the initial rapid upward movement of rod 14.

With rod 14 released from its first configuration, the lower annular face 76 of rod 14 and bore 22 surrounding bore 16 provides means responsive to an upward motion of the electric line 18 for moving rod 14 and hammer 22 from their first configuration to their second configuration. As previously mentioned, face 76 and bore 22 provide means for retaining rod 14 in an attached configuration with electric line 18, with electric line 18 being retained at least partially in bore 16, and as shown in the figures, extending downward through bore 16, so that rod 14 moves concurrently therewith. It is to be appreciated that with other tool elements 20 the means for moving rod 14 from its first configuration to its second configuration including means for retaining rod 14 in an attached configuration with electric line 18 may vary. The motion of the electric line 18 is a quick, generally upwards, translatory motion and as tip 77 abuts against face 76 and bore 22 to retain rod 14 in an attached configuration with electric line 18, rod 14 and hammer 22 are moved upward therewith rapidly. As rod 14 and hammer 22 reach the second configuration, hammer 22 strikes anvil 78 with an upward jarring action and the jarring action is transferred downward to tool element 20 by the means for transferring the upward jarring action from anvil 78 to element 20 including anvil 78's fixed attachment to tubular member 12 and the means for leaving tubular member 12, which as shown in the figures comprises allen screws 72, in its attached configuration with element 20 in a manner as previously described.

In the event the first upward jar does not free tool element 20, a series of upward jars may be generated by lowering the electric line 18 and allowing rod 14 and hammer 22 to return to a lower configuration, which may be the same as the first configuration, from which another quick, generally upward, translatory motion of the electric line 18 may move rod 14 and hammer 22 quickly upwards to the second configuration to strike hammer 22 against anvil 78 and provide another upward jarring action which may be transferred by the means for transferring upward jarring action from anvil 78 to tool element 20. As mentioned rod 14 and hammer 22 may move to the lower configuration by their own weight, although electric line 18 may be frictionally engaged in bore 16 so that as electric line 18 is lowered with a generally translatory motion, its weight would aid in returning rod 14 and hammer 22 to the lower configuration. As further mentioned, a light spring may be included to assist in moving the rod 14 and hammer 22 to a lower configuration.

In the event tool element 20 becomes unstuck by the upward jarring, hoisting operations may then proceed from the point at which the tool element 20 became stuck. However, if continued upward jarring does not free tool element 20, the hoist force may be increased to a third predetermined value which is higher than both the first predetermined pressure and the second predetermined pressure, and which is sufficient to shear allen screws 72 and separate element 20 from the apparatus 10. Tubular member 12 and rod 14 may now be withdrawn from the well by the electric line 18. With tubular member 12, rod 14 and electric line 18 removed from the well, a fishing trip may be made to retrieve the stuck tool element 20. Appropriate action may then be taken in the well bore to alleviate conditions in the well conducive to sticking, after which the apparatus 10 including an element 20, which may be the same as original element 20, with the electric line 18 appropriately reconnected may be reassembled at the surface and the apparatus 10 including element 20 lowered into the well 15 as previously discussed.

Additional, Exemplary Embodiment

In a further embodiment of a jarring apparatus according to the present invention, a similar tubular member may be threadably attached, for example, to a tool element and the bushing including the anvil may be attached by a shearable means such as allen screws 72 to the tubular member. An annular fishing neck may surround the upper end of the tubular member to allow fishing tools to connect thereto when upward jarring is unsuccessful for freeing the stuck tool element.

It is also within the scope of the invention that a jarring apparatus according to the present invention may have a tubular member and a rod having an elongated bore therethrough disposed slidably therein which include longitudinal splined portions. The rod may include at least one radial opening positioned near the bottom of the rod with each opening having a lug biased outward by a helical spring, with the rod being held in a similar first configuration as rod 14 by a shearable means. The lugs comprise hammers held in a recessed configuration by the tubular member which, when the rod moves to a second configuration are biased outward by the spring into corresponding radial voids on the inside of the tubular member. The upper surface of the voids provides an anvil face which the hammer lugs strike to provide an upward jarring action.

The hammer lugs include an angled lower face which mates with a tapered surface extending radially inward and downward from the anvil face which as the rod moves downward to a lower configuration, biases the lugs inward and allows the rod to move to a lower configuration which may in a similar manner as previously discussed, be the same as its first configuration. The longitudinal splined portions prevent rotation of the rod in the tubular member and maintain alignment of the hammer lugs and the radial voids so that jarring action may be obtained as the rod and hammer move rapidly to the second configuration. The radial voids may also be an annular groove with the upper surface providing an annular anvil face and include an annular tapered surface extending radially inward and downward from the anvil face for biasing the lugs inward, and will as may be appreciated for this embodiment, the invention will not require splines to maintain alignment of the lugs and the annular groove.

As previously mentioned rod 14 and hammer 22 of the embodiment shown in the figures are slidably disposed in tubular member 12 and as shown in the figures, the slidable surfaces may comprise a simple form of a sleeve bearing, although bearings such as ball bearings may be used in a manner known to the art for both the embodiment shown in the figures as well as the unseen further embodiments as appropriate to provide a means for slidably disposing the rod and hammer of both the embodiment shown in the figures and the unseen embodiments in tubular member 12.

The foregoing disclosure and description of the invention is illustrative and explanatory thereof, and various changes in the method steps as well as in the details of the illustrated apparatus may be made within the scope of the appended claims without departing from the spirit of the invention.

What is claimed is:

1. Jarring apparatus for use in oil wells and the like, comprising:

a tubular member disposed in a well;

a cylindrical rod slidably disposed in said member, said cylindrical rod having a central, longitudinal bore therein;

a tool element disposed in said well and attached to the lower end of said tubular member;

an electric line extending through said bore with its lower end connected to said tool element;

responsive means responsive to a generally upward motion of said electric line for moving said cylindrical rod from a first configuration in said tubular member to a second configuration, said responsive means further including means for retaining said rod in an attached configuration with said electric line so that said rod moves concurrently therewith, and wherein there is further included:

initial disconnect means for disconnecting said electric line from said element responsive to a first generally upward force in said electric line;

final disconnect means for leaving said tubular member disposed in said well above said element in its attached configuration with said element;

release means associated with said cylindrical rod and said tubular member for releasing said cylindrical rod from its first configuration responsive to a second predetermined force in said electric line;

a hammer attached to said cylindrical rod for motion therewith by the generally upward motion of said electric line toward an opposed, spaced anvil fixedly attached to said tubular member, the quick, generally upward motion of said cylindrical rod from its first configuration to its second configuration moving said hammer to strike against said anvil and provide a generally upward jarring action to jar said element in a generally upward direction;

transferring means included with said apparatus for transferring said upward jarring action from said anvil to said element for jarring said element in a generally upward direction; and motion means attached to the upper end of said electric line for motion of said electric line.

2. The jarring apparatus of claim 1, wherein said first configuration is a lower configuration and wherein said second configuration is an upper configuration, wherein the motion of said electric line is reciprocal, and wherein there is further included a rod movement means for moving said cylindrical rod downward from its second configuration responsive to a downward motion of said electric line to a further lower configuration which may be the same as the first configuration.

3. The jarring apparatus of claim 2, wherein the reciprocal motion of said electric line provides means for a reciprocal motion of said rod and said hammer.

4. The jarring apparatus of claim 3, wherein the reciprocal motion of said hammer provides a series of said upward jarring actions.

5. The jarring apparatus of claim 1, wherein said invention includes restraining means for restraining further generally upward motion of said cylindrical rod past its second configuration.

6. The jarring apparatus of claim 5, wherein said apparatus further includes release means for releasing said tool element from said apparatus responsive to a third predetermined force in said electric line.

7. The jarring apparatus of claim 6, wherein said restraining means for restraining further upward motion of said rod includes said anvil.

8. The jarring apparatus of claim 7, wherein said release means for releasing said tool element from said apparatus is a shearable member attaching said anvil to said tubular member.

9. The jarring apparatus of claim 7, wherein said release means for releasing said tool element from said apparatus is a shearable element attaching said tool element to said tubular member.

10. The jarring apparatus of claim 1, wherein said means included with said apparatus for transferring said upward jarring action from said anvil to said element for jarring said element in a generally upward direction includes the fixedly attachment of said anvil to said tubular member and said means for leaving said tubular member disposed in said well above said element in its attached configuration with said element.

11. The jarring apparatus of claim 10, wherein said final disconnect means for leaving said tubular member disposed in said well above said element in its attached configuration with said element includes a shearable element which shears responsive to a third predetermined force in said electric line which is higher than said first predetermined force and said second predetermined force.

12. The jarring apparatus of claim 1, wherein said final disconnect means for leaving said tubular member disposed in said well above said element in its attached configuration with said element includes a shearable element which shears responsive to a third predetermined force in said electric line which is higher than said first predetermined force and said second predetermined force.

13. The jarring apparatus of claim 1, wherein said release means associated with said cylindrical rod and said tubular member for releasing said cylindrical rod from its first configuration responsive to a second predetermined force in said electric line further provides means for slowing the initial upward motion of said rod and said hammer as said electric line disconnects from said tool element to restrain premature shearing of said means for leaving said tubular member disposed in said well above said element in its attached configuration with said element.

14. Jarring apparatus for use in oil wells and the like comprising:

a tubular member disposed in a well;

a cylindrical rod slidably disposed in said member, said cylindrical rod having a central longitudinal bore therein;

a tool element disposed in said well and attached to the lower end of said tubular member;

an electric line extending through said bore with its lower end connected to said tool element;

reciprocal motion means for causing reciprocal motion of said cylindrical rod in said tubular member, said means including responsive means responsive to a generally upward motion of said electric line for moving said cylindrical rod from a first lower configuration in said tubular member to a second higher configuration, said means further including means for retaining said rod in an attached configuration with said electric line with said electric line retained at least partially in said bore so that said rod moves concurrently therewith, and wherein there is further included:

initial disconnect means for disconnecting said electric line from said element responsive to a first generally upward force in said electric line;

final disconnect means for leaving said tubular member disposed in said well above said element in its attached configuration with said element;

release means associated with said cylindrical rod and said tubular member for releasing said cylindrical rod from its first configuration responsive to a second predetermined force in said electric line;

rod movement means for moving said cylindrical rod downward from its second higher configuration to a lower configuration which may be the same as the first configuration;

a hammer attached to said cylindrical rod for motion therewith by a quick, generally upward motion of said electric line toward an opposed anvil fixedly attached to said tubular member and positioned a distance from said hammer, the quick generally upward motion of said cylindrical rod from its first to its second configuration by said electric line moving said hammer to strike against said anvil and provide a generally upward jarring action to jar said element in a generally upward direction;

transferring means included with said apparatus for transferring said upward jarring action from said anvil to said element for jarring said element in a generally upward direction, said means including; and reciprocal motion means attached to the upper end of said electric line for causing reciprocal motion of said electric line.

15. The jarring apparatus of claim 14, wherein there is further included with said tubular member restraining means for restraining further generally upward motion of said cylindrical rod past its second higher configuration.

16. The jarring apparatus of claim 14, wherein said transferring means included with said apparatus for transferring said upward jarring action from said anvil to said element for jarring said element in a generally upward direction includes the fixedly attachment of said anvil to said tubular member, and said final disconnect means for leaving said tubular member disposed in said well above said element in its attached configuration with said element.

17. The jarring apparatus of claim 16, wherein said final disconnect means for leaving said tubular member disposed in said well above said element in its attached configuration with said element includes a shearable element which shears responsive to a third predetermined force in said electric line which is higher than said first predetermined force and said second predetermined force.

18. The jarring apparatus of claim 14, wherein said final disconnect means for leaving said tubular member disposed in said well above said element in its attached configuration with said element includes a shearable element which shears responsive to a third predetermined force in said electric line which is higher than said first predetermined force and said second predetermined force.

19. The jarring apparatus of claim 14, wherein said release means associated with said cylindrical rod and said tubular member for releasing said cylindrical rod from its first configuration responsive to a second predetermined force in said electric line further provides slowing means for slowing the initial upward motion of said rod and said hammer, as said electric line disconnects from said tool element to restrain premature shearing of said final disconnect means for leaving said tubular member disposed in said well above said element in its attached configuration with said element.

20. Jarring apparatus for use in oil wells and the like, comprising:

an elongated tubular member disposed in a well;

an elongated cylindrical rod slidably disposed in said member, said cylindrical rod having a central longitudinal bore therein;

a tool element disposed in said well and attached to the lower end of said tubular member;

an electric line extending through said bore with its lower end connected to said tool element;

response means responsive to a generally upward motion of said electric line for moving said cylindrical rod from a lower first configuration in said tubular member to an upper second configuration, said means further including means for retaining said rod in an attached configuration with said electric line, with said electric line extending downward through said bore so that said rod moves concurrently therewith, and wherein there is further included:

initial disconnect means for disconnecting said electric line from said element responsive to a first generally upward force in said electric line;

final disconnect means for leaving said tubular member disposed in said well above said element in its attached configuration with said element;

release means associated with said cylindrical rod and said tubular member for releasing said cylindrical rod for movement from its first configuration responsive to a second predetermined force in said electric line;

an annular hammer slidably disposed in said tubular member, said hammer projecting radially outward from the lower end of said cylindrical rod for translatory motion therewith;

an anvil projecting radially inward from said tubular member, said anvil being opposed to said hammer and fixedly attached in an upper portion of said tubular member a longitudinal distance from said hammer so that the upward motion of said rod by a quick, generally upward motion of said electric line causes said hammer to rapidly move toward said opposed anvil and strike against said anvil to provide a generally upward jarring action to said anvil which is transferred by said tubular member and said means for leaving said tubular member disposed in said well above said element in its attached configuration with said element, and to jar said element in a generally upward direction;

transferring means included with said apparatus for transferring said upward jarring action from said anvil to said element for jarring said element in a generally upward direction, said means including the fixedly attachment of said anvil to said tubular member and said means for leaving said tubular member disposed in said well above said element in its attached configuration with said element;

an annular void between said rod and said tubular member, said void being enclosed at its upper end by said anvil and enclosed at its lower end by said hammer;

communicating means for communicating said void to an annulus surrounding said tubular member; and translatory motion means attached to the upper end of said electric line for translatory motion of said electric line in said well.

21. The jarring apparatus of claim 18, wherein the translatory motion of said electric line is reciprocal, and wherein there is further included rod movement means for moving said cylindrical rod downward from its second configuration to a further lower configuration which may be the same as the first configuration to a further lower configuration which may be the same as the first configuration responsive to a downward motion of said electric line.

22. The jarring apparatus of claim 19, wherein the reciprocal motion of said electric line provides means for reciprocal motion of said rod and said hammer.

23. The jarring apparatus of claim 20, wherein the reciprocal motion of said hammer provides a series of said jarring actions.

24. The jarring apparatus of claim 18, wherein said invention includes a restraining means for restraining further generally upward motion of said cylindrical rod past its second configuration.

25. The jarring apparatus of claim 22, wherein said apparatus further includes release means for releasing said tool element from said apparatus responsive to a third predetermined force in said electric line.

26. The jarring apparatus of claim 17, wherein said restraining means for restraining further upward motion of said rod includes said anvil.

27. The jarring apparatus of claim 24, wherein said release means for releasing said tool element from apparatus is a shearable member attaching said anvil to said tubular member.

28. The jarring apparatus of claim 24, wherein said release means for releasing said tool element from said apparatus is a shearable element attaching said tool element to said tubular member.

29. The jarring apparatus of claim 18, wherein said transferring means included with said apparatus for transferring said upward jarring action from said anvil to said element for jarring said element in a generally upward direction includes the fixedly attachment of said anvil to said tubular member and said initial disconnect means for leaving said tubular member disposed in said well above said element in its attached configuration with said element.

30. The jarring apparatus of claim 27, wherein said final disconnect means for leaving said tubular member disposed in said well above said element in its attached configuration with said element includes a shearable element which shears responsive to a third predetermined force in said electric line which is higher than said first predetermined force and said second predetermined force.

31. The jarring apparatus of claim 18, wherein said final disconnect means for leaving said tubular member disposed in said well above said element in its attached configuration with said element includes a shearable element which shears responsive to a third predetermined force in said electric line which is higher than said first predetermined force and said second predetermined force.

32. A method of producing an upward jarring action to jar a stuck tool element disposed in a well loose, comprising the steps of:

(a) applying a generally upward motion to an electric line connected at its lower end to a tool element stuck in a well bore to disconnect the electric line from the tool element responsive to a first upward force in the electric line;

(b) having the electric line pass slidably through an anvil spaced above and attached to the tool element for concurrent motion therewith as the tool element is moved longitudinally in the well for performing operations within the well;

(c) having the electric line pass slidably through an opposed hammer positioned below the anvil and disposed between the anvil and tool element in an attached first configuration with the tool element for concurrent motion therewith as the tool element is moved longitudinally in the well for performing operations within the well;

(d) releasing the hammer from its first configuration by a second upward predetermined force in the electric line transmitted to the hammer by an annular means fixedly surrounding the electric line between the hammer in its first configuration and the tool element which abuts against the hammer for concurrent upward motion therewith as the electric line is moved upward in the well; and (e) moving the anvil upward by a quick, generally upward motion of the electric line toward the opposed anvil to a second configuration striking the anvil to provide a generally upward jarring action to jar the tool element in a generally upward direction for releasing the stuck tool element from its stuck position in the well.

33. The method of claim 32, wherein step "e" is repeated a number of times producing a series of jarring forces.

34. The method of claim 32, wherein, if the tool fails to become unstuck, there is included the further step of disconnecting the tool element by applying an upward force in the electric line in an amount significantly greater than said first upward force and said second upward predetermined force, causing the electric line to become disconnected from said tool element.

* * * * *